US006695446B2

(12) United States Patent
Sato et al.

(10) Patent No.: US 6,695,446 B2
(45) Date of Patent: Feb. 24, 2004

(54) IMAGE-TRANSFER MEDIUM FOR INK-JET PRINTING, PRODUCTION PROCESS OF TRANSFERRED IMAGE, AND CLOTH WITH TRANSFERRED IMAGE FORMED THEREON

(75) Inventors: Yuko Sato, Kanagawa-ken (JP); Masahiko Higuma, Chiba-ken (JP); Yoshiyuki Shino, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/193,288

(22) Filed: Jul. 12, 2002

(65) Prior Publication Data

US 2003/0107633 A1 Jun. 12, 2003

Related U.S. Application Data

(62) Division of application No. 09/235,335, filed on Jan. 22, 1999, now abandoned.

(30) Foreign Application Priority Data

Jan. 28, 1998 (JP) ..... 10-016222

(51) Int. Cl.[7] ..... B41J 2/01
(52) U.S. Cl. ..... 347/105; 347/101; 428/32.1
(58) Field of Search ..... 347/105, 103, 347/1, 101; 428/195, 98, 178, 187, 189, 32.1; 346/135.1

(56) References Cited

U.S. PATENT DOCUMENTS

| | | | | | |
|---|---|---|---|---|---|
| 4,818,591 | A | * | 4/1989 | Kitamura et al. | 428/216 |
| 5,273,808 | A | * | 12/1993 | Mano et al. | 428/195 |
| 5,501,902 | A | | 3/1996 | Kronzer | 428/323 |
| 6,139,672 | A | | 10/2000 | Sato et al. | 156/235 |
| 6,406,142 | B1 | * | 6/2002 | Sato et al. | 347/103 |

FOREIGN PATENT DOCUMENTS

| | | | |
|---|---|---|---|
| EP | 0 466 336 | A1 | 1/1992 |
| EP | 0 805 049 | A1 | 11/1997 |
| JP | 360224580 | A | 11/1985 |
| JP | 362178384 | A | 8/1987 |
| JP | 8-207426 | | 8/1996 |
| JP | 8-207450 | | 8/1996 |

OTHER PUBLICATIONS

Patent Abstracts of Japan, vol. 096, No. 012, Dec. 26, 1996 (with respect to JP 8–207450 of Aug. 13, 1996).

* cited by examiner

*Primary Examiner*—Stephen Meier
*Assistant Examiner*—Manish Shah
(74) *Attorney, Agent, or Firm*—Fitzpatrick, Cella, Harper & Scinto

(57) ABSTRACT

Disclosed herein is an image-transfer medium for ink-jet printing, including a base material, and a releasing layer and a transfer layer, both, provided on the base material, wherein the transfer layer includes fine particles of a thermoplastic resin, a thermoplastic resin binder, inorganic fine particles and a coupling agent.

4 Claims, No Drawings

IMAGE-TRANSFER MEDIUM FOR INK-JET PRINTING, PRODUCTION PROCESS OF TRANSFERRED IMAGE, AND CLOTH WITH TRANSFERRED IMAGE FORMED THEREON

CROSS REFERENCE TO RELATED APPLICATION

This is a divisional application of Application No. 09/235,335, filed Jan. 22, 1999, now abandoned.

BACKGROUND OF THE INVENTION

1. Field of the Invention

The present invention relates to an image-transfer medium suitable for use in forming an image on a transfer-printing medium by transfer printing, a process for producing a transferred image using this image-transfer medium, and a cloth with transferred image formed thereon, and more particularly to an image-transfer medium for ink-jet printing, in which an ink-jet printing system is used upon forming an image on a transfer layer making up the image-transfer medium, a process for producing a transferred image by using such an image-transfer medium to transfer-print an image on a transfer-printing medium, thereby forming the transferred image, and a cloth with a transferred image formed thereon.

2. Related Background Art

As ink-jet printing systems, there are known various ink ejection systems, for example, an electrostatic attraction system, a system in which a piezoelectric element is used to give an ink mechanical vibration or change, or a system in which an ink is heated to form bubbles in the ink, thereby using the pressure thus produced. Printing is conducted by generating and ejecting minute droplets of an ink by one of these ink ejection systems and applying parts or all of the droplets to a recording medium. Such an ink-jet printing system attracts attention as a simple system which scarcely produces noise and can conduct high-speed printing and color printing. In recent years, ink-jet printers making good use of such a system, by which color printing can be simply conducted, have been widely spread.

In recent years, the ink-jet printers, by which color printing can be simply conducted as described above, have been spread, and there has thus been an increasing demand for conducting color printing on various recording media using these printers. In order to meet such a demand, particular attention is paid to printing techniques making good use of an image-transfer medium (image-transfer paper) in that printing can be conducted irrespective of the form of recording media (transfer-printing media), namely, an image formation can be performed on any medium which does not permit direct printing by a printer.

Some image-transfer media making good use of an ink-jet printing system to form an image thereon have been proposed to date. Japanese Patent Application Laid-Open No. 8-207426 has proposed an ink-jet printing sheet in which an ink-receiving layer is composed of a thermoplastic resin, a crystalline plasticizer and a tackifier, thereby permitting sticking an transferred image to a transfer-printing medium by heating alone. Japanese Patent Application Laid-Open No. 8-207450 has proposed an image-transfer medium in the form of a sheet capable of permitting ink-jet printing and heat transfer printing, comprising a base material layer and a heat transfer layer which is composed of a particulate thermoplastic resin, inorganic porous fine particles and a binder. U.S. Pat. No. 5,501,902 has proposed an image-transfer medium for ink-jet comprising a transfer layer of a structure that a cationic resin, an ink-viscosity adjuster and the like are added in addition to the above-described components.

These image-transfer media according to the prior art have sufficient performance as to formation of an image thereon by ink-jet printing and transfer printing of the image therefrom to transfer-printing media. However, the performance as to fastness properties of the transferred images after the transfer to the transfer-printing media has not been said to be sufficient. More specifically, when washing an image-transferred article, there has been a problem that the optical density of the image is deteriorated due to such a cause that dyes which form the image and materials of the transfer layer which carry the image are run out into water, or that the surface of the cloth having the transferred image is fuzzed.

SUMMARY OF THE INVENTION

It is an object of the present invention to provide an image-transfer medium by which an image formed thereon by making good use of an ink-jet printing method can be transferred to a transfer-printing medium such as a cloth to form a good transferred image, and particularly to provide an excellent image-transfer medium for ink-jet printing, which has a high ink absorbency, permits the formation of an image high in optical density and clearness, and can form a good transferred image having high fastness to washing when the image is transferred to a transfer-printing medium such as a cloth, a production process of a transferred image having such properties as described above, and a cloth with a transferred image formed thereon.

The above object can be achieved by the present invention described below.

According to the present invention, there is thus provided an image-transfer medium for ink-jet printing, comprising a base material, and a releasing layer and a transfer layer, both, provided on the base material, wherein the transfer layer comprises fine particles of a thermoplastic resin, a thermoplastic resin binder, inorganic fine particles and a coupling agent.

According to the present invention, there is also provided a process for producing a transferred image, comprising the steps of forming an image on the transfer layer of the image-transfer medium for ink-jet printing described above in accordance with an ink-jet printing system; and transfering the transfer layer to the transfer-printing medium by overlapping the image-transfer medium, on which the image has been formed, on a transfer-printing medium each other.

According to the present invention, there is further provided a cloth with a transferred image formed thereon by the production process described above.

DETAILED DESCRIPTION OF THE PREFERRED EMBODIMENTS

The image-transfer medium for ink-jet printing according to the present invention includes a releasing layer and a transfer layer, both, provided on a base material. In such a constitution, the transfer layer is required to have the following three functions:

First, a function of well absorbing inks for ink-jet printing to form a high-quality image and satisfactorily retaining the image formed;

Second, a function of adhering to a transfer-printing medium such as a cloth or film to permit the transfer printing of the image retained on the transfer layer to the transfer-printing medium such as the cloth in a satisfactory state; and Third, a function of firmly fixing materials present in the transfer layer to the layer after transferred to a transfer-printing medium such as a cloth or film, thereby being able to prevent deterioration of a transferred image formed, which may be possibly caused when the cloth or the like, which is the transfer-printing medium on which the image has been formed, is washed, or when the transfer-printing medium on which the image has been formed is wetted with water or sweat.

According to the present invention, there is provided an image-transfer medium for ink-jet printing having a transfer layer which satisfies all the above-described functions. More specifically, in the present invention, fine particles of a thermoplastic resin, a thermoplastic resin binder, inorganic fine particles and a coupling agent are used as materials for forming the transfer layer, thereby being able to achieve all the performance requirements described above. The roles (functions) of the respective materials will hereinafter be described specifically.

The fine particles of the thermoplastic resin used for forming the transfer layer in the present invention denote fine particles formed of a water-insoluble thermoplastic resin. Porous fine particles of the thermoplastic resin may preferably be used. When such fine particles of the thermoplastic resin are contained in a transfer layer, they are present in the transfer layer with the shape as the fine particles retained as they are, without forming a film, at a state before the formation of a transferred image, so that the transfer layer becomes a porous layer. Therefore, when inks are applied to the transfer layer by an ink-jet printing system, the inks can be satisfactorily absorbed in voids defined by the fine particles and retained therein. When the porous fine particles of the thermoplastic resin are used in this case, the inks are also absorbed in pores in the fine particles, so that the ink absorbency of the transfer layer can be more enhanced.

On the other hand, when an image formed on the transfer layer is brought into contact with a transfer-printing medium and heated and pressed from the side of, for example, the base material of the image-transfer medium to transfer the image to the transfer-printing medium, the fine particles of the thermoplastic resin in the transfer layer are melted together with the thermoplastic resin binder, whereby the transfer layer is transferred to the transfer-printing medium, and these fine particles are also formed into a film. As a result, it is possible to satisfactorily fix coloring materials to the transfer-printing medium such as a cloth or film. In this case, the thermoplastic resin is present in a state of fine particles in the transfer layer before melting. Therefore, when the transfer layer is transferred to, for example, a cloth, these fine particles penetrate between fibers of the cloth and are melted in a state that they surround the fibers, and the coloring materials are fixed thereafter. As a result, a beautiful transferred image can be provided without exposing the color of the underlying fibers even when the cloth is stretched.

In the present invention, a thermoplastic resin binder for bonding the fine particles of the thermoplastic resin to one another to form the transfer layer is included. The thermoplastic resin binder has a function of bonding the transfer layer to a transfer-printing medium upon transfer printing.

When the transfer layer is formed by these materials alone, however, there is a problem that the optical density of the resulting transferred image is lowered because the transfer layer penetrates into the cloth in excess, and the coloring materials penetrate deeply. There is also a problem that the surface of the cloth is fuzzed by the same main cause when the cloth is washed, and so the optical density of the transferred image is lowered.

Therefore, the present inventors have carried out an extensive investigation with a view toward solving these problems. As a result, it has been found that when inorganic fine particles are added to the transfer layer, the excess penetration of the transfer layer into the cloth can be prevented, and so the above problems can be solved. More specifically, the addition of the inorganic fine particles having no melt property under heat to the transfer layer can prevent the thermoplastic resin making up the transfer layer from penetrating into the cloth in excess, so that a film can be formed on the surface of the cloth to provide a bright transferred image having a high optical density. Further, when the image-transfer medium according to the present invention is used to form a transferred image on a cloth, the transfer layer is bonded to fibers on the surface of the cloth, so that the cloth can be prevented from being fuzzed by its washing to provide a transfer-printed cloth having high fastness to washing.

As described above, however, the inorganic fine particles are not melted under heat, nor do they have adhesion to the transfer-printing medium, so that the excess addition of the inorganic fine particles has involved a problem that they fall off by rubbing such as washing to rather deteriorate the fastness properties. Therefore, the present inventors have carried out an additional investigation as to this problem. As a result, it has been found that when a coupling agent is added in addition to the above three components, the fall-off of the inorganic fine particles can be prevented to provide a transferred image having a higher fastness to washing.

The coupling agent used in the present invention means a material having an action that an inorganic material is bonded to an organic material either through a chemical reaction or by enhancing affinity of both materials for each other in a mixed system of the inorganic material and the organic material. Specific examples thereof include coupling agents of the silane, titanate and aluminate types. The structures of these coupling agents include those having group(s) (methoxy group, ethoxy group, etc.) capable of hydrolyzing to bond to the surfaces of inorganic particles, functional group(s) (amino group, vinyl group, epoxy group, etc.) capable of reacting with an organic substance, or functional group(s) (isopropyl group, octyl group, etc.) capable of enhancing the affinity for an organic substance, with silica, titanium or aluminum as the central element.

In a more preferred embodiment of the present invention, a coupling agent having a functional group reactive to a thermoplastic resin is used as the coupling agent, and a thermoplastic resin reactive to the reactive group of the coupling agent is used as the thermoplastic resin for the fine particles of thermoplastic resin or thermoplastic resin binder. In the case of this embodiment, the inorganic fine particles are chemically reacted and bonded to the fine particles of the thermoplastic resin or the thermoplastic resin binder, so that the inorganic fine particles can be more firmly bonded to the thermoplastic resin. Therefore, higher fastness to washing is achieved in a cloth or the like with a transferred image formed thereon by using the image-transfer medium for ink-jet printing according to the present invention.

In another more preferred embodiment of the present invention, the transfer layer is provided as a layer of a two-layer structure. For example, it is preferred that a layer containing a coupling agent having a functional group reactive to a thermoplastic resin, and a layer containing the thermoplastic resin reactive to the coupling agent be separately formed to provide a transfer layer composed of at least these two layers. More specifically, when the inorganic fine particles, the reactive coupling agent and the reactive thermoplastic resin are present in the same layer, there is no gainsaying the possibility that these three components may react with one another before transferring the transfer layer to a transfer-printing medium. If the three components react with one another, the plasticity of the thermoplastic resin is impaired, so that there is a risk of forming the cause that the transfer printing of the transfer layer to the transfer-printing medium is impeded. On the contrary, when the layer containing the coupling agent and the layer containing the thermoplastic resin are formed as separate layers, the possibility of the reaction among the three components in the stage prior to the transfer printing can be eliminated. In the case where the transfer layer is provided as the two-layer structure, the inorganic fine particles may be added to either layer. According to an investigation by the present inventors, however, it has been found that when a layer is formed from the inorganic fine particles together with the coupling agent in the state that the inorganic fine particles have been reacted with the coupling agent in advance, a higher effect is achieved.

In another embodiment of the present invention, it is also effective to use a coupling agent having no reactivity to the thermoplastic resin as the coupling agent. In this case, the coupling agent has the function of reacting with the inorganic fine particles to enhance the affinity of the surfaces of the inorganic fine particles for the thermoplastic resin. The use of such a coupling agent can enhance the adhesion between the inorganic fine particles and the thermoplastic resin, so that the fall-off of the inorganic fine particles can be effectively prevented. In this case, the plasticity of the thermoplastic resin is not impeded because it is not that firm bonding occurs between the thermoplastic resin ant the inorganic fine particles. Therefore, the transferability of the transfer layer to a transfer-printing medium is also not impeded.

In a further embodiment of the present invention, it is also effective to provide a layer composed of a uniform film containing no fine particle of the thermoplastic resin between the transfer layer and the releasing layer. The provision of this uniform film layer has the following two advantages. First, the transfer layer can be formed with more easy. More specifically, in the image-transfer medium for ink-jet printing according to the present invention, the porous transfer layer having good ink absorbency is provided on the releasing layer. When the porous layer is provided on a layer having low adhesion, such as the releasing layer, however, the adhesion between these layers becomes poor, so that in some cases, the transfer layer may be separated from the releasing layer upon handling of the resulting image-transfer medium. On the other hand, when a transfer layer is provided as a layer of a two-layer structure in such a manner that the uniform film layer is situated on the side of the releasing layer, the adhesion between the transfer layer and the releasing layer is improved, and so the above problem becomes hard to arise.

Second, the fastness to washing of a transferred image can be more improved. More specifically, when the transfer layer is provided as a layer of the two-layer structure, the transfer layer adjacent to the releasing layer comes to form a face of the transferred image when the transfer layer, on which an image has been formed, is transferred to a transfer-printing medium such as a cloth, so that the uniform film layer comes to cover the surface of the transferred image. Therefore, it is considered that the coloring materials forming the image are closely fixed to the cloth in a state more shielded, and the fastness properties of the transferred image are hence enhanced. In addition, the presence of the uniform film layer can more effectively prevent the inorganic fine particles from falling off. In the present invention, it is more effective to use a thermoplastic resin having high reactivity to or high affinity for the functional group of the coupling agent as a material for forming the uniform film layer.

In the above case, it is more preferred that the same thermoplastic resins be used in the uniform film layer and the porous layer containing the fine particles of the thermoplastic resin for absorbing and retaining inks. More specifically, when the same materials are used as materials for forming these two layers, adhesion between the two layers can be enhanced, and so the fastness properties of the transferred image can be more improved. Further, since a difference in refractive index between the two layers becomes small, the transfer layer after transfer printing become transparent, and so a clear transferred image can be provided.

The image-transfer medium for ink-jet printing according to the present invention has a releasing layer together with the transfer layer of such a constitution as described above. The presence of the releasing layer allows the transfer layer having the excellent properties described above to efficiently and easily transfer to a transfer-printing medium such as a cloth or film, thereby forming a transferred image. When the transfer layer, on which an image has been formed, is transferred to a cloth, and the base material carrying the transfer layer is then separated and removed from the cloth, for example, a problem that the transfer layer transferred is separated from the cloth together with the base material, or a part of the transfer layer remains on the base material without being transferred, and so the image is impaired can be effectively prevented.

The individual materials used for the image-transfer media for ink-jet printing according to the present invention will hereinafter be described specifically.

First, as a material used for the fine particles of the thermoplastic resin forming the transfer layer, any fine particles may be used so far as they are fine particles formed of a water-insoluble thermoplastic resin. Examples of such a thermoplastic resin include polyethylene, polypropylene, polyvinyl acetate, polyvinyl alcohol, polyvinyl acetal, poly (meth)acrylic acid, poly(meth)acrylates, polyacrylic acid derivatives, polyacrylamide, polyether, polyester, polycarbonate, cellulosic resins, polyacrylonitrile, polyimide, polyamide, polyvinyl chloride, polyvinylidene chloride, polystyrene, Thiokol, polysulfone, polyurethane and copolymers of these resins. Of these, polyethylene, polypropylene, poly(meth)acrylic acid, poly(meth)-acrylates, polyvinyl acetate, polyvinyl chloride, polyurethane, polyamide and copolymers thereof are more preferably used in the present invention.

In the image-transfer media for ink-jet printing according to the present invention, it is preferred to use fine particles of a thermoplastic resin composed of polyamide, particularly, a copolymer of nylon 6 and nylon 12 because the coloring ability of dyes becomes better, and so a clearer image can be provided.

The particle size of these fine particles used in the present invention is preferably within a range of from 0.05 to 100 $\mu$m, more preferably from 0.2 to 50 $\mu$m, most preferably from 5 to 20 $\mu$m from the viewpoints of the ink absorbency of the resulting transfer layer and the clearness of the resulting image. If the particle size of the fine particles of the thermoplastic resin is smaller than 0.05 μm, interparticle voids become too small when a transfer layer is formed from such fine particles, and so the transfer layer is hard to have sufficient ink absorbency. Further, if the particles are too small, the smoothness of the surface of the resulting transfer layer becomes high, so that the transfer layer becomes hard to penetrate into the fibers of a cloth when transferred to the cloth, and a transferred image tends to be formed as an even continuous film on the surface of the cloth. As a result, any satisfactory transferred image may not be provided in some cases because the transferred image becomes easy to be separated, and the transfer layer cracks to expose the underlying fibers when the cloth is stretched. If the particle size is greater than 100 μm on the other hand, the resolution of the resulting image becomes low, so that no clear image can be provided.

As the fine particles of the thermoplastic resin used in the present invention and formed of any of the above-mentioned materials, porous fine particles may preferably be used. When the porous fine particles are used in the transfer layer in the present invention, the ink absorbency of the transfer layer can be more enhanced, so that a greater amount of inks can be absorbed in a thinner layer. Further, the provision of the thin transfer layer not only permits transferring the resulting image with more ease, but also makes hand of the transferred image on a cloth or the like soft, so that a more preferable transfer-printed cloth can be provided.

As the fine particles of the thermoplastic resin used in the present invention, it is more preferable to use those formed of a material which permits forming an image on the resulting transfer layer by means of a general-purpose ink-jet printer and then simply transferring the image in a home or the like. Taking this regard into consideration, the thermoplastic resin used preferably has a melting point ranging from 70° C. to 200° C., more preferably from 80° C. to 180° C., most preferably from 100° C. to 150° C. When a thermoplastic resin having a melting point lower than 70° C. is used, the fine particles of the thermoplastic resin in the resulting transfer layer may possibly be melted to form a continuous film according to conditions where the resulting image-transfer medium is shipped or stored. After coating the base material with the fine particles of the thermoplastic resin, it is necessary to dry the coating layer at a temperature lower than the melting point of the fine particles of the thermoplastic resin. It is thus preferable to use the thermoplastic resin having a melting point of at least 70° C. even from the viewpoint of production efficiency. On the other hand, if a resin having a melting point higher than 200° C. is used, higher energy is required for transferring an image formed on the resulting transfer layer to a transfer-printing medium. It is hence difficult to simply form a transferred image to the transfer-printing medium such as a cloth, which is an object of the present invention.

When a cloth is used as a transfer-printing medium in the present invention, it is preferable to use a resin having a low melt viscosity taking the adhesion of the resulting transfer layer to the cloth into consideration. More specifically, when a resin having a high melt viscosity is used, the adhesion between the resulting transfer layer and the cloth becomes poor, so that the transfer layer formed into a continuous film on the cloth becomes easy to be separated from the cloth. On the other hand, when the material having a low melt viscosity is used, the resulting transfer layer becomes easy to penetrate into fibers of the cloth upon transfer printing, thereby providing a good transferred image without exposing the color of the underlying fibers even when the cloth is stretched after the transfer printing.

In order not to impair hand of the cloth as much as possible after transfer printing, it is preferable to use a material capable of forming a film having high flexibility.

The thermoplastic resin binder used for forming the transfer layer of the image-transfer medium for ink-jet printing according to the present invention together with the fine particles of the thermoplastic resin will now be described. The binder is added for purposes of bonding the fine particles of the thermoplastic resin to one another to form the transfer layer and of fixing the transfer layer, on which an image has been formed, to a transfer-printing medium such as a cloth upon transfer printing. As with the fine particles of the thermoplastic resin, any conventionally known water-insoluble thermoplastic resin may be used for the binder in the present invention. Specifically, those mentioned above as the materials for the fine particles of the thermoplastic resin may be used.

In the present invention, a weight ratio of the fine particles of the thermoplastic resin to the thermoplastic resin binder is preferably within a range of from 1/2 to 50/1, more preferably from 1/2 to 20/1, most preferably from 1/2 to 15/1. If the proportion of the fine particles of the thermoplastic resin is too high, adhesion among the fine particles of the thermoplastic resin or between the fine particles of the thermoplastic resin and the releasing layer becomes insufficient, which makes it impossible to form a transfer layer having sufficient strength. On the other hand, if the proportion of the fine particles of the thermoplastic resin is too low, it is difficult to provide a transfer layer having excellent ink absorbency and permitting the formation of an image having excellent clearness thereon.

The inorganic fine particles used in the transfer layer together with the fine particles of the thermoplastic resin and the thermoplastic resin binder will now be described. As described above, the addition of the inorganic fine particles into the transfer layer can prevent the thermoplastic resin making up the transfer layer from penetrating into a transfer-printing medium such as a cloth in excess upon transfer of the transfer layer to the transfer-printing medium, so that a film of the transfer layer can be formed on the surface of the cloth to form a clear transferred image having high optical density. In addition, the addition of the inorganic fine particles into the transfer layer permits the formation of voids, so that the ink absorbency of the transfer layer can be more enhanced to form a brighter image.

No particular limitation is imposed on the inorganic fine particles used for such a purpose so far as they are inorganic particles having no melt property under heat and a white color. Specific examples thereof include silica, aluminum silicate, magnesium silicate, hydrotalcite, calcium carbonate, titanium oxide, clay, talc and (basic) magnesium carbonate. Of these, a material having high dyeing property may preferably be used, since a dye in an ink is better fixed to the surface of a transfer-printing medium such as a cloth.

When a material having a higher void volume is used from among the inorganic particles, the ink absorbency of the resulting transfer layer is also enhanced, and so a clearer image can be provided. The particle size of the inorganic particles used in the present invention is preferably equal to that of the fine particles of the thermoplastic resin described above as much as possible. The reason for it is that when particles different in particle size are added to each other, particles having a smaller diameter are filled in interparticle voids of particles having a greater diameter, so that the void volume of the resulting transfer layer is reduced.

The coupling agent added to the transfer layer together with the inorganic fine particles will now be described.

As described above, the coupling agent is added for the purpose of preventing the inorganic fine particles from falling off from an image after transfer printing by force of rubbing or the like to deteriorate the image. Specifically, a material having high reactivity to the inorganic fine particles or having high reactivity to or high affinity for the thermoplastic resins may be used. More specifically, a coupling agent of the silane, titanate or aluminate type may be used.

Examples of the silane type coupling agent include those the organic functional group of which is an amino, ureido, vinyl, methacryl, epoxy, mercapto or isocyanate group. These silane type coupling agents have a functional group reactive to the thermoplastic resins. In the present invention, the optimum coupling agent may be suitably selected from among these coupling agents according to the kinds of the fine particles of the thermoplastic resin and the thermoplastic resin binder used in the transfer layer. Specifically, the coupling agent is preferably used in the following combination.

For example, the silane type coupling agent having an isocyanate group is preferably used for resins having a hydroxyl, amino, carboxyl or mercapto group. The silane type coupling agent having an epoxy group is preferably used for resins having a carboxyl group, mercapto group, double bond or isocyanate group. The silane type coupling agent having an amino group is preferably used for chlorine-containing resins, fluororesins, and resins having a chlorosulfone, carboxyl, ester, epoxy, methylol or sulfone group.

Examples of the titanate type coupling agent include those having an organic functional group such as an isostearoyl, dodecylbenzenesulfonyl, dioctyl pyrophosphate or dioctyl phosphate group. However, these coupling agents have no reactivity to thermoplastic resins, but can react with inorganic particles to enhance the affinity of the surfaces of the inorganic particles for thermoplastic resins. As with the case of the silane type coupling agents, the optimum coupling agent may be preferably selected for use from among these titanate type coupling agents according to the kind of the thermoplastic resins used in the transfer layer. It is particularly preferred to use a titanate type coupling agent having an organic functional group the polarity of which is close to that of the thermoplastic resin used in the transfer layer in combination with the inorganic fine particles, since the affinity of the surfaces of the inorganic particles for the thermoplastic resin can be more enhanced. For example, when a thermoplastic resin such as polyethylene or polypropylene is used, it is preferred to use a titanate type coupling agent having an organic functional group low in polarity, such as an isostearoyl group. On the other hand, when polyamide or the like is used, it is preferred to use a titanate type coupling agent having an organic functional group high in polarity, such as an N-aminoethyl•aminoethyl group.

The aluminate type coupling agent includes acetoalkoxyaluminum diisopropionate. As with the titanate type coupling agents, this coupling agent can enhance the affinity of the surfaces of the inorganic particles for thermoplastic resins.

Processes for adding these coupling agents include a dry process, a wet process and integral blending.

To each transfer layer of the image-transfer media for ink-jet printing according to the present invention, may be added various additives in addition to the above-described materials. In particular, the addition of a cationic material to the transfer layer permits the achievement of higher fastness to washing. More specifically, coloring materials commonly used in ink-jet printers are water-soluble anionic dyes. Such a coloring material is taken together into the transfer layer at the time the fine particles of the thermoplastic resin are melted by heat upon transfer printing, and fixed in the form of a film to a transfer-printing medium such as a cloth. However, the film thus formed may not become completely even in some case. In such a case, the dye may exude when the cloth is immersed in water upon, for example, washing. When the cationic material is added to the transfer layer, however, it can react with the dye to insolubilize the dye, thereby preventing the dye from being dissolved out.

Specific examples of the cationic material used in this case include the following materials:

- cationically modified products of resins such as polyvinyl alcohol, hydroxyethyl cellulose and polyvinyl pyrrolidone;
- polymers and copolymers of amine monomers such as allylamine, diallylamine, allyl sulfone, dimethylallyl sulfone and diallyldimethylammonium chloride, and of acrylic monomers having a primary, secondary or tertiary amine, or quaternary ammonium base at their side chains, such as dimethylaminoethyl (meth)acrylate, diethyl-aminoethyl (meth)acrylate, methylethylaminoethyl (meth)acrylate, dimethylaminostyrene, diethylaminostyrene, methylethylaminostyrene, N-methylacrylamide, N,N'-dimethylacrylamide, N,N-diethylaminoethyl methacrylamide and quaternized compounds thereof; and
- resins having a primary, secondary or tertiary amine, or quaternary ammonium base, such as dicyanamide, at their main chains.

Further, it is effective to add a plasticizer for the fine particles of the thermoplastic resin or the thermoplastic resin binder into the transfer layer from the viewpoint of enhancing transferability. By adding the plasticizer, the melt viscosity of the transfer layer becomes low upon its transfer, i.e., its heating, so that its adhesion to a transfer-printing medium such as a cloth can be more enhanced, and the transferability is improved. As the plasticizer used in this case, any conventionally-known plasticizer may be used. Specific examples thereof include phthalates such as diethyl phthalate, dioctyl phthalate, dimethyl phthalate and dibutyl phthalate, phosphates such as tributyl phosphate and triphenyl phosphate, adipates such as octyl adipate and isononyl adipate, sebacates such as dibutyl sebacate and dioctyl sebacate, acetyltributyl citrate, acetyltriethyl citrate, dibutyl maleate, diethylhexyl maleate, dibutyl fumarate, trimellitic acid type plasticizers, polyester type plasticizers, epoxy type plasticizers, stearin type plasticizers, chlorinated paraffins, toluenesulfonamide and derivatives thereof, and 2-ethylhexyl p-hydroxybenzoate.

A surfactant may also be added into the transfer layer for the purpose of improving the permeability of the transfer layer to inks. More specifically, when the surfactant is added into the transfer layer, the wettability of the surfaces of the particles contained in the transfer layer is improved, and so the penetrability of water-based inks into the transfer layer is enhanced when an image is formed by an ink-jet printing system. As the surfactant used in this case, may be used any of nonionic surfactants commonly used. More specifically, surfactants of the ether, ester, ether-ester and fluorine-containing types may be used.

The layer thickness of the thus-formed transfer layer of each of the image-transfer media for ink-jet printing according to the present invention is preferably within a range of from 15 to 250 $\mu$m, more preferably from 40 to 200 $\mu$m, most preferably from 50 to 150 $\mu$m. The layer thickness of the portion of the transfer layer having voids for absorbing and retaining inks, on which an image can be formed by ink-jet printing, is preferably within a range of from 10 to 150 μm, more preferably from 30 to 120 μm, most preferably from 40 to 100 μm. If the transfer layer of the image-transfer medium is too thick, the flexibility of a flexible transfer-printing medium such as a cloth is deteriorated at its portion on which the transfer layer has been transferred by transfer printing, so that hand of this portion becomes poor. If the transfer layer is too thin on the other hand, the strength of the transfer layer becomes weak, which forms the cause that the fastness to washing, and the like of the resulting transferred image are deteriorated. Further, if the portion having the voids for absorbing and retaining inks is too thin, it is difficult to form any high-definition image because inks are not sufficiently absorbed and retained therein.

The releasing layer making up the image-transfer media for ink-jet printing according to the present invention together with the transfer layer having such constitution as described above has an effect of facilitating the separation of the transfer layer from the base material when the transfer layer is transferred to a transfer-printing medium such as a cloth.

Examples of a material for forming such a releasing layer first include, as hot-melt materials, waxes such as carnauba wax, paraffin wax, microcrystalline wax and castor wax; higher fatty acids and derivatives thereof such as metal salts and esters, for example, stearic acid, palmitic acid, lauric acid, aluminum stearate, lead stearate, barium stearate, zinc stearate, zinc palmitate, methyl hydroxystearate and glycerol monohydroxystearate; polyamide resins; petroleum resins; rosin derivatives; coumarone-indene resins; terpene resins; novolak resins; styrene resins; olefin resins such as polyethylene, polypropylene, polybutene and polyolefin oxides; and vinyl ether resins. Besides, silicone resins, fluorosilicone resins, fluoroolefin-vinyl ether terpolymers, perfluoroepoxy resins, thermosetting acrylic resins having perfluoroalkyl groups at their side chains, and vinylidene fluoride type hardening resins may also be used.

As the base material used in the image-transfer media for ink-jet printing according to the present invention, on which such a releasing layer and transfer layer as described above are supported, any base material may be used so far as it can be conveyed in printers and has sufficient heat resistance to withstand a heat transfer treatment. Specific examples thereof include films of thermoplastic resins such as polyester, diacetate resins, triacetate resins, acrylic polymers, polycarbonate, polyvinyl chloride, polyimide, cellophane and celluloid, paper, and flexible base materials such as fabrics and nonwoven fabrics. In the image-transfer media for ink-jet printing according to the present invention, it is particularly preferred to use a flexible base material because even when the surface of a transfer-printing medium to be transfer-printed is curved, the transfer layer of each image-transfer medium can be transfer-printed along the shape of the transfer-printing medium, so that a transferred image can also be satisfactorily formed on any transfer-printing media other than flat media.

No particular limitation is imposed on the thickness of the base material. However, it is preferably within limits conveyable in a general-purpose ink-jet printer. For example, a base material having a thickness of from 30 to 200 μm may preferably be used.

No particular limitation is also imposed on the processes for forming the releasing layer and the transfer layer on the base material. However, examples thereof include a process in which suitable materials for forming the transfer layer are dissolved or dispersed in a proper solvent to prepare a coating formulation, and the coating formulation is applied to the a base material by coating or the like, a process in which a film is formed from suitable materials for forming the transfer layer, and the film is laminated on a base material, and a process in which the suitable materials are extruded in the form of a film on a base material. Examples of a coating method of the coating formulation include roll coater, blade coater, air knife coater, gate roll coater, bar coater, size pressing, Symsizer, spray coating, gravure coating and curtain coater methods.

The image-transfer media for ink-jet printing according to the present invention produced by the above-described process are applied to the production process of a transferred image according to the present invention, which comprises the steps of forming an image on the transfer layer of an image-transfer medium for ink-jet printing in accordance with an ink-jet printing system; and transfering the transfer layer to the transfer-printing medium by overlapping the image-transfer medium, on which the image has been formed, on a transfer-printing medium each other.

More specifically, an image is first formed on the transfer layer of the image-transfer medium according to the present invention by an ink-jet printing system. The image-transfer medium, on which the image has been formed, and a transfer-printing medium such as a cloth or film are then laid to overlap each other with the transfer layer on the side of the transfer-printing medium to heat them from the side opposite to the transfer layer of the image-transfer medium, thereby transferring the transfer layer to the transfer-printing medium. Finally, the base material is separated from the transfer-printing medium to form a transferred image on the transfer-printing medium such as the cloth. As an ink-jet printer used in this case, any commercially available ink-jet printer may be employed as it is. No particular limitation is also imposed on coloring materials constituting inks used in the image-forming step. For example, conventionally known anionic coloring materials may be used.

In the production process of a transferred image according to the present invention, as described above, an image is formed on the transfer layer, and the image is transferred to a transfer-printing medium such as a cloth to form the transferred image. Therefore, this process is different from a process of directly printing an image on a cloth to form the image. It is thus unnecessary to specially change coloring materials according to the kinds of fiber materials or the like making up transfer-printing media. Accordingly, when a cloth is used as the transfer-printing medium to form a transferred image on the cloth in accordance with the production process of a transferred image as described above, a cloth with a satisfactory transferred image formed thereon can be provided by a simple process. No particular limitation is also imposed on the cloth used in forming the transferred image in the present invention. Examples of the material making up the cloth include cotton, hemp, silk, wool, rayon, polyester, nylon, acrylic fiber, acetate fiber, triacetate fiber and polyurethane, and blended fibers thereof. The cloths made up of these materials may be used in any forms of a woven fabric, a knitted fabric and a nonwoven fabric.

The present invention will hereinafter be described more specifically by the following Examples and Comparative Example. Incidentally, all designations of "part" or "parts" and "%" as will be used in the following examples mean part or parts by weight and % by weight unless expressly noted.

Materials used in the Examples and Comparative Examples are described below.

Fine particles of thermoplastic resin:

Fine particle a of thermoplastic resin:

Porous fine particles of a nylon resin (Orgasol 3501EDX NAT, trade name, product of Elf Atochem S.A., particle size: 10 μm)

Fine particle b of thermoplastic resin:

Fine particles of an ethylene resin (AC polyethy A-6, trade name, product of Allied Signal Co, particle size: 6 μm)

Binder resin:

Thermoplastic resin binder a:

Ethylene-acrylic acid copolyer emulsion (Hytec E-8778, trade name, product of Toho Chemical Industry Co., Ltd., solid content: 25%)

Thermoplastic resin binder b:

Urethane polymer emulsion (Takelac W-635c, trade name, product of Takeda Chemical Industries, Ltd., solid content: 35%)

Thermoplastic resin binder c:

Ethylene resin emulsion (Chemipearl V-300, trade name, product of Mitsui Petrochemical Industries, Ltd., particle size: 6 μm, solid content: 40%)

Coupling agent:

Coupling agent a:

Silane coupling agent (reactive group: epoxy group) (SH-6040, trade name, product of Toray Dow Corning Silicone Co., Ltd.; used in the form of a 5% aqueous solution)

Coupling agent b:

Silane coupling agent (reactive group: amino group) (SH-6020, trade name, product of Toray Dow Corning Silicone Co., Ltd.; used in the form of a 5% aqueous solution)

Coupling agent c:

Titanate coupling agent (organic functional group: isostearoyl group) (KR-TTS, trade name, product of Ajinomono Co., Inc.; used in the form of a 5% IPA solution)

Coupling agent d:

Titanate coupling agent (organic functional group: N-aminoethyl•aminoethyl group) (KR-44, trade name, product of Ajinomono Co., Inc.; used in the form of a 5% IPA solution)

Inorganic fine particles:

Inorganic fine particle a:

Silica (Mizukasil P-78A, trade name, product of Mizusawan industrial Chemicals, Ltd., particle size: 3 μm)

Various additives:

Cationic resin a:

Acrylic cationic resin (EL Polymer NWS-16, trade name, product of Shin-Nakamura Chemical Co., Ltd.; solid content: 30%)

Plasticizer a:

N-Ethyl-o,p-toluenesulfonamide (Topcizer No. 3, trade name, product of Fuji Amide Chemical Co., Ltd.)

Surfactant a:

Fluorine-containing surfactant (Surflon S-131, trade name, product of Seimi Chemical Co., Ltd.; solid content: 30%)

Base material:

Base material a provided with a releasing layer:

Release paper (ST60 OKT-T, trade name, product of Lintec Corporation)

Of these, proper materials were used to prepare coating formulations of their corresponding compositions shown below. In this case, the addition of the coupling agent and inorganic fine particles was conducted in accordance with a wet process comprising adding a mixture obtained by dissolving the coupling agent in water or isopropyl alcohol (IPA) in advance, adding the inorganic fine particles to the solution and thoroughly mixing them to other components of each coating formulation. The thus-prepared coating formulation was then applied to the base material a by means of a bar coater under the following conditions and dried to form a transfer layer, thereby obtaining respective image-transfer media according to Examples and Comparative Examples each having the releasing layer and transfer layer. The constitution of the transfer layers of the image-transfer media according to Examples 1 to 6 and Comparative Examples 1 to 4 are shown collectively in Tables 1 to 4.

Example 1:

<Composition of transfer layer>

| | |
|---|---|
| Fine particle a of thermoplastic resin | 100 parts |
| Thermoplastic resin binder a | 400 parts (solid content: 100 parts) |
| Inorganic fine particle a | 15 parts |
| Coupling agent a | 15 parts |
| Cationic resin a | 50 parts (solid content: 15 parts) |
| Surfactant a | 8 parts (solid content: 2.4 parts) |
| Plasticizer a | 20 parts |
| IPA (Isopropyl alcohol) | 200 parts. |

(Coating conditions)

Drying conditions: 70° C./10 min.

Coating thickness: 60 μm.

Example 2:

<Composition of transfer layer>

| | |
|---|---|
| Fine particle b of thermoplastic resin | 100 parts |
| Thermoplastic resin binder b | 170 parts (solid content: 50 parts) |
| Inorganic fine particle a | 10 parts |
| Coupling agent b | 10 parts |
| Cationic resin a | 33 parts (solid content: 10 parts) |
| Surfactant a | 6 parts (solid content: 1.2 parts) |
| IPA | 100 parts. |

(Coating conditions)

Drying conditions: 70° C./10 min.

Coating thickness: 80 μm.

Example 3:

<Composition of first layer (surface side) of transfer layer>

| | |
|---|---|
| Fine particle a of thermoplastic resin | 100 parts |
| Thermoplastic resin binder a | 400 parts (solid content: 100 parts) |
| Cationic resin a | 50 parts (solid content: 15 parts) |
| Surfactant a | 8 parts (solid content: 2.4 parts) |
| Plasticizer a | 20 parts |
| IPA | 100 parts. |

(Coating conditions)

Drying conditions: 70° C./10 min.

Coating thickness: 60 μm.

<Composition of second layer (releasing layer side) of transfer layer>

| | |
|---|---|
| Inorganic fine particle a | 15 parts |
| Coupling agent a | 15 parts |
| Thermoplastic resin binder c | 150 parts (solid content: 60 parts) |
| IPA | 50 parts. |

-continued (Coating conditions)

Drying conditions: 70° C./10 min.
Coating thickness: 20 μm.
Example 4:
<Composition of first layer of transfer layer>

| | |
|---|---|
| Fine particle a of thermoplastic resin | 100 parts |
| Thermoplastic resin binder a | 400 parts (solid content: 100 parts) |
| Cationic resin a | 50 parts (solid content: 15 parts) |
| Surfactant a | 8 parts (solid content: 2.4 parts) |
| Plasticizer a | 20 parts |
| IPA | 100 parts. |

(Coating conditions)

Drying conditions: 70° C./10 min.
Coating thickness: 60 μm.
<Composition of second layer of transfer layer>

| | |
|---|---|
| Thermoplastic resin binder c | 100 parts. |

(Coating conditions)

Drying conditions: 70° C./5 min.
Coating thickness: 5 μm.
<Composition of third layer of transfer layer>

| | |
|---|---|
| Inorganic fine particle a | 15 parts |
| Coupling agent a | 15 parts |
| Thermoplastic resin binder c | 150 parts (solid content: 60 parts) |
| IPA | 50 parts. |

(Coating conditions)

Drying conditions: 70° C./10 min.
Coating thickness: 20 μm.
Example 5:
<Composition of transfer layer>

| | |
|---|---|
| Fine particle b of thermoplastic resin | 100 parts |
| Thermoplastic resin binder b | 170 parts (solid content: 50 parts) |
| Inorganic fine particle a | 10 parts |
| Coupling agent c | 10 parts |
| Cationic resin a | 33 parts (solid content: 10 parts) |
| Surfactant a | 6 parts (solid content: 1.2 parts) |
| IPA | 100 parts. |

(Coating conditions)

Drying conditions: 70° C./10 min.
Coating thickness: 80 μm.
Example 6:
<Composition of transfer layer>

| | |
|---|---|
| Fine particle a of thermoplastic resin | 100 parts |
| Thermoplastic resin binder b | 250 parts (solid content: 100 parts) |
| Inorganic fine particle a | 15 parts |
| Coupling agent d | 15 parts |
| Cationic resin a | 33 parts (solid content: 10 parts) |
| Surfactant a | 8 parts (solid content: 2.4 parts) |
| Plasticizer a | 20 parts |
| IPA | 200 parts. |

(Coating conditions)

Drying conditions: 70° C./10 min.
Coating thickness: 60 μm.
Comparative Example 1:
<Composition of transfer layer>

| | |
|---|---|
| Fine particle a of thermoplastic resin | 100 parts |
| Thermoplastic resin binder a | 400 parts (solid content: 100 parts) |
| Inorganic fine particle a | 15 parts |
| Cationic resin a | 50 parts (solid content: 15 parts) |
| Surfactant a | 8 parts (solid content: 2.4 parts) |
| Plasticizer a | 20 parts |
| IPA | 200 parts. |

(Coating conditions)

Drying conditions: 70° C./10 min.
Coating thickness: 60 μm.
Comparative Example 2:
<Composition of transfer layer>

| | |
|---|---|
| Fine particle a of thermoplastic resin | 100 parts |
| Thermoplastic resin binder a | 400 parts (solid content: 100 parts) |
| Cationic resin a | 50 parts (solid content: 15 parts) |
| Surfactant a | 8 parts (solid content: 2.4 parts) |
| Plasticizer a | 20 parts |
| IPA | 100 parts. |

(Coating conditions)

Drying conditions: 70° C./10 min.
Coating thickness: 60 μm.
Comparative Example 3:
<Composition of transfer layer>

| | |
|---|---|
| Fine particle b of thermoplastic resin | 100 parts |
| Thermoplastic resin binder b | 170 parts (solid content: 50 parts) |
| Inorganic fine particle a | 10 parts |
| Cationic resin a | 33 parts (solid content: 10 parts) |
| Surfactant a | 6 parts (solid content: 1.2 parts) |
| IPA | 20 parts. |

(Coating conditions)

Drying conditions: 70° C./10 min.
Coating thickness: 80 μm.
Comparative Example 4:
<Composition of transfer layer>

| | |
|---|---|
| Fine particle a of thermoplastic resin | 100 parts |
| Thermoplastic resin binder b | 250 parts (solid content: 100 parts) |
| Inorganic fine particle a | 15 parts |
| Cationic resin a | 33 parts (solid content: 10 parts) |
| Surfactant a | 8 parts (solid content: 2.4 parts) |
| Plasticizer a | 20 parts |
| IPA | 100 parts. |

(Coating conditions)

Drying conditions: 70° C./10 min.
Coating thickness: 60 μm.

Table 1 Constitution of transfer layers of image-transfer media of Examples 1 to 3 (*: expressed in terms of solid content)

TABLE 1

Constitution of transfer layers of image-transfer media of Examples 1 to 3 (*: expressed in terms of solid content)

| | | Component | Content (part) |
|---|---|---|---|
| Ex. 1 | First layer | Porous fine particles of nylon resin (Fine particle a of thermoplastic resin) | 100 |

TABLE 1-continued

Constitution of transfer layers of image-transfer media of Examples 1 to 3 (*: expressed in terms of solid content)

| | | Component | Content (part) |
|---|---|---|---|
| | | Ethylene-acrylic acid copolymer emulsion (Thermoplastic resin binder a) | 100* |
| | | Silica (Inorganic fine particle a) | 15 |
| | | Silane type (reactive group: epoxy group) (Coupling agent a) | 15 |
| | | Acrylic cationic resin (Cationic resin a) | 15* |
| | | Fluorine-containing surfactant (Surfactant a) | 2.4* |
| | | N-Ethyl-o,p-toluenesulfonamide (Plasticizer a) | 20 |
| | | Isopropyl alcohol | 200 |
| Ex. 2 | First layer | Fine particles of ethylene resin (Fine particle b of thermoplastic resin) | 100 |
| | | Urethane polymer emulsion (Thermoplastic resin binder b) | 50* |
| | | Silica (Inorganic fine particle a) | 10 |
| | | Silane type (reactive group: amino group) (Coupling agent b) | 10 |
| | | Acrylic cationic resin (Cationic resin a) | 10* |
| | | Fluorine-containing surfactant (Surfactant a) | 1.2* |
| | | Isopropyl alcohol | 100 |
| Ex. 3 | First layer | Porous fine particles of nylon resin (Fine particle a of thermoplastic resin) | 100 |
| | | Ethylene-acrylic acid copolymer emulsion (Thermoplastic resin binder a) | 100* |
| | | Acrylic cationic resin (Cationic resin a) | 15* |
| | | Fluorine-containing surfactant (Surfactant a) | 2.4* |
| | | N-Ethyl-o,p-toluenesulfonamide (Plasticizer a) | 20 |
| | | Isopropyl alcohol (IPA) | 100 |
| | Second layer | Silica (Inorganic fine particle a) | 15 |
| | | Silane type (reactive group: epoxy group) (Coupling agent a) | 15 |
| | | Ethylene resin emulsion (Thermoplastic resin binder c) | 60* |
| | | Isopropyl alcohol | 50 |

TABLE 2

Constitution of transfer layers of image-transfer media of Examples 4 to 6 (*: expressed in terms of solid content)

| | | Component | Content (part) |
|---|---|---|---|
| Ex. 4 | First layer | Porous fine particles of nylon resin (Fine particle a of thermoplastic resin) | 100 |
| | | Ethylene-acrylic acid copolymer emulsion (Thermoplastic resin binder a) | 100* |
| | | Acrylic cationic resin (Cationic resin a) | 15* |
| | | Fluorine-containing surfactant (Surfactant a) | 2.4* |
| | | N-Ethyl-o,p-toluenesulfonamide (Plasticizer a) | 20 |
| | | Isopropyl alcohol (IPA) | 100 |
| | Second layer | Ethylene resin emulsion (Thermoplastic resin binder c) | 100 |

TABLE 2-continued

Constitution of transfer layers of image-transfer media of Examples 4 to 6 (*: expressed in terms of solid content)

| | | Component | Content (part) |
|---|---|---|---|
| | | Silica (Inorganic fine particle a) | 15 |
| | Third layer | Silane type (reactive group: epoxy group) (Coupling agent a) | 15 |
| | | Ethylene resin emulsion (Thermoplastic resin binder c) | 60* |
| | | Isopropyl alcohol | 50 |
| Ex. 5 | First layer | Fine particles of ethylene resin (Fine particle b of thermoplastic resin) | 100 |
| | | Urethane polymer emulsion (Thermoplastic resin binder b) | 50* |
| | | Silica (Inorganic fine particle a) | 10 |
| | | Titanate type (organic functional group: isostearoyl group) (Coupling agent c) | 10 |
| | | Acrylic cationic resin (Cationic resin a) | 10* |
| | | Fluorine-containing surfactant (Surfactant a) | 1.2* |
| | | Isopropyl alcohol | 100 |
| Ex. 6 | First layer | Porous fine particles of nylon resin (Fine particle a of thermoplastic resin) | 100 |
| | | Urethane polymer emulsion (Thermoplastic resin binder b) | 100* |
| | | Silica (Inorganic fine particle a) | 15 |
| | | Titanate type (organic functional group: N-aminoethyl · aminoethyl group) (Coupling agent d) | 15 |
| | | Acrylic cationic resin (Cationic resin a) | 10* |
| | | Fluorine-containing surfactant (Surfactant a) | 2.4* |
| | | N-Ethyl-o,p-toluenesulfonamide (Plasticizer a) | 20 |
| | | Isopropyl alcohol | 200 |

TABLE 3

Constitution of transfer layers of image-transfer media of Comparative Examples 1 to 3 (*: expressed in terms of solid content)

| | Component | Content (part) |
|---|---|---|
| Comp. Ex. 1 | Porous fine particles of nylon resin (Fine particle a of thermoplastic resin) | 100 |
| | Ethylene-acrylic acid copolymer emulsion (Thermoplastic resin binder a) | 100* |
| | Silica (Inorganic fine particle a) | 15 |
| | Acrylic cationic resin (Cationic resin a) | 15* |
| | Fluorine-containing surfactant (Surfactant a) | 2.4* |
| | N-Ethyl-o,p-toluenesulfonamide (Plasticizer a) | 20 |
| | Isopropyl alcohol (IPA) | 200 |
| Comp. Ex. 2 | Porous fine particles of nylon resin (Fine particle a of thermoplastic resin) | 100 |
| | Ethylene-acrylic acid copolymer emulsion (Thermoplastic resin binder a) | 100* |
| | Acrylic cationic resin (Cationic resin a) | 15* |
| | Fluorine-containing surfactant (Surfactant a) | 2.4* |
| | N-Ethyl-o,p-toluenesulfonamide (Plasticizer a) | 20 |
| | Isopropyl alcohol (IPA) | 100 |

TABLE 3-continued

| | Constitution of transfer layers of image-transfer media of Comparative Examples 1 to 3 (*: expressed in terms of solid content) | |
|---|---|---|
| | Component | Content (part) |
| Comp. Ex. 3 | Fine particles of ethylene resin (Fine particle b of thermoplastic resin) | 100 |
| | Urethane polymer emulsion (Thermoplastic resin binder b) | 50* |
| | Silica (Inorganic fine particle a) | 10 |
| | Acrylic cationic resin (Cationic resin a) | 10* |
| | Fluorine-containing surfactant (Surfactant a) | 1.2* |
| | Isopropyl alcohol (IPA) | 100 |

TABLE 4

| | Constitution of transfer layers of image-transfer media of Comparative Example 4 (*: expressed in terms of solid content) | |
|---|---|---|
| | Component | Content (part) |
| Comp. Ex. 4 | Porous fine particles of nylon resin (Fine particle a of thermoplastic resin) | 100 |
| | Urethane polymer emulsion (Thermoplastic resin binder b) | 100* |
| | Silica (Inorganic fine particle a) | 15 |
| | Acrylic cationic resin (Cationic resin a) | 10* |
| | Fluorine-containing surfactant (Surfactant a) | 2.4* |
| | N-Ethyl-o,p-toluenesulfonamide (Plasticizer a) | 20 |
| | Isopropyl alcohol (IPA) | 200 |

Printing was conducted on the thus-produced image-transfer media of Examples 1 to 6 and Comparative Examples 1 to 4 in accordance with a back printing film mode by means of an ink-jet color printer, BJC-600J (trade name, manufactured by Canon Inc.). After the printing, each of the image-transfer media thus printed was placed on a 100% cotton T-shirt (BEEFY, trade name; product of HANES Co.) with a side of the transfer layer of the image-transfer medium, on which the image had been formed, aligned with a portion of the T-shirt to be transferred. The transfer layer was transferred to the T-shirt by heating by means of a heat transfer machine (surface temperature of hot plate: 200° C.; transfer pressure: 80 g/cm$^2$) from the base material side of the image-transfer medium to form an image-transferred article. Each transferred image on the image-transferred article thus formed was evaluated as to (1) image quality, (2) fastness to washing, (3) transferability and (4) shelf stability in accordance with the following respective evaluation methods.

(1) Image Quality:

Two patches of different colors were printed adjoiningly to each other on each of the image-transfer media, whereby evaluation was made by whether bleeding occurred or not at the boundary between the two colors. More specifically, images obtained adjoiningly with two colors among yellow, cyan, blue and red in 100% duty at all pixels were used in the evaluation to visually observe them as to whether bleeding occurred or not at boundaries between the respective adjacent colors, thereby making evaluation in accordance with the following 4-rank standard:

A: No bleeding occurred at boundaries among all the colors;

B: Bleeding occurred only at the boundary between the secondary colors (between blue and red);

C: Bleeding occurred even at the boundary between the secondary color and the primary color (between blue and cyan); and D: Bleeding occurred at boundaries among all the colors.

(2) Fastness to Washing:

Each of the T-shirts, the image-transferred aritcle formed in the above-described manner, was subjected each 10 times to washing for 10 minutes and rinsing for 10 minutes by a household two-tub washing machine, dewatered and then dried in a dryer. The degree of decoloring at the transfer-printed portion of the T-shirt thus washed and dried was visually observed to evaluate the sample as to the fastness to washing in accordance with the following standard. The transferred image formed on the T-shirt was composed of black, cyan, magenta and yellow print patches (each, 15 mm×15 mm) of 100% duty at all pixels.

A: No decoloring occurred;

B: Decoloring somewhat occurred; and

C: Decoloring occurred to a considerable extent.

(3) Transferability:

The degree of separation at the transfer-printed portion of each of the washed and dried T-shirts after subjected to the evaluation test as to the fastness to washing was visually observed to evaluate the sample as to the transferability in accordance with the following standard:

A: The transfer layer was not separated;

B: The transfer layer was partially separated; and

C: The transfer layer was separated as a whole.

The respective evaluation results of the Examples and Comparative Examples are shown in Table 5.

(4) Shelf Stability of Image-Transfer Medium:

After the thus-produced image-transfer media (sheets) of Examples 1 to 6 and Comparative Examples 1 to 4 were placed in a polypropylene bag and left to stand for 2 days in a thermostatic chamber controlled at 60° C. and 50% relative humidity, each of them was used to transfer-print an image on a T-shirt in the same manner as described above, thereby forming a transferred image. The T-shirt thus transfer-printed was then evaluated as to (2) fastness to washing and (3) transferability in the same manner as described above, thereby regarding the evaluation results thereof as the evaluation as to (4) shelf stability of image-transfer medium.

TABLE 5

| | Evaluation results | | | | | | |
|---|---|---|---|---|---|---|---|
| | Before shelf | | | After shelf | | | |
| | (1) | (2) | (3) | (1) | (2) | (3) | Kind of coupling |
| Ex. 1 | A | A | A | A | A | B | Silane type (reactive group: epoxy) |
| Ex. 2 | A | A | A | B | A | B | Silane type (reactive group: amino) |
| Ex. 3 | A | A | A | A | A | A | Silane type (reactive group: epoxy), 2-layer structure |
| Ex. 4 | A | A | A | A | A | A | Silane type (reactive group: epoxy), 3-layer structure |

TABLE 5-continued

| | Evaluation results | | | | | | |
|---|---|---|---|---|---|---|---|
| | Before shelf | | | After shelf | | | |
| | (1) | (2) | (3) | (1) | (2) | (3) | Kind of coupling |
| Ex. 5 | B | A | A | B | A | B | Titanate type (functional group: isostearoyl) |
| Ex. 5 | B | A | A | A | A | B | Titanate type (functional group: N-aminoethyl·amino-ethyl) |
| Comp. Ex. 1 | A | C | A | A | C | A | No coupling agent was used |
| Comp. Ex. 2 | B | C | A | B | C | A | Neither coupling agent nor inorganic fine particles were used |
| Comp. Ex. 3 | B | C | A | B | C | A | No coupling agent was used |
| Comp. Ex. 4 | B | C | A | B | C | A | No coupling agent was used |

(Note)
(1): Image quality.
(2): Fastness to washing.
(3): Transferability

According to the present invention, as described above, there can be provided image-transfer media for ink-jet printing, which always permit the simple and stable formation of satisfactory transferred images on transfer-printing media such as cloths making good use of an ink-jet printing system and have excellent shelf stability. In particular, the use of such an image-transfer medium permits the formation of a high-density and clear transferred image because of its high ink absorbency. In addition, an image-transferred article such as a cloth with a transferred image formed thereon using the image-transfer medium according to the present invention is soft in hand even at the portion on which the transferred image has been formed, and has high fastness to washing.

What is claimed is:

1. An image-transfer medium for ink-jet printing comprising a base material, and a releasing layer on the base material and at least two transfer layers provided on the releasing layer, said transfer layers in combination comprise fine particles of a thermoplastic resin, a thermoplastic resin binder, inorganic fine particles and a coupling agent, at least one of said transfer layers containing the coupling agent and a second of said transfer layers containing a thermoplastic resin reactive to the coupling agent, wherein the coupling agent chemically bonds the inorganic fine particles to the fine particles of the thermoplastic resin or the thermoplastic resin binder when said transfer layers are heated to conduct transfer printing.

2. The image-transfer medium according to claim 1, wherein the transfer layer closest to the base material side is a uniform film transfer layer free of fine particles of the thermoplastic resin.

3. The image-transfer medium according to claim 2, wherein the uniform film transfer layer and the other transfer layer(s) comprise the same thermoplastic resin.

4. The image transfer medium according to claim 1, wherein the coupling agent and the inorganic fine particles are present in the same transfer layer.

* * * * *

UNITED STATES PATENT AND TRADEMARK OFFICE

CERTIFICATE OF CORRECTION

PATENT NO. : 6,695,446 B2
DATED : February 24, 2004
INVENTOR(S) : Yuko Sato et al.

It is certified that error appears in the above-identified patent and that said Letters Patent is hereby corrected as shown below:

Title page,
Item [75], Inventors, "Yuko Sato, Kanagawa-ken (JP);" should read -- Yuko Sato, Kawasaki (JP); --. "Masahiko Higuma, Chiba-ken (JP);" should read -- Masahiko Higuma, Togane (JP); --. "Yoshiyuki Shino, Kanagawa-ken (JP)" should read -- Yoshiyuki Shino, Kawasaki (JP) --.

Column 1,
Line 61, "an" should read -- a --.

Column 2,
Line 50, "medium" should read -- medium with --.

Column 5,
Line 37, "ant" should read -- and --.
Line 47, "easy." should read -- ease. --.
Line 60, "hard" should read -- unlikely --.

Column 6,
Line 21, "become" should read -- becomes --.

Column 8,
Line 1, "hand" should read -- the hand --.

Column 9,
Line 9, "those" should read -- those of which --.
Line 10, "of which" should be deleted.

Column 10,
Line 6, "case." should read -- cases. --.

Column 11,
Line 8, "hand" should read -- the hand --.

Column 12,
Line 20, "medium" should read -- medium with --.
Line 65, "Example." should read -- Examples. --.

UNITED STATES PATENT AND TRADEMARK OFFICE

CERTIFICATE OF CORRECTION

PATENT NO. : 6,695,446 B2
DATED : February 24, 2004
INVENTOR(S) : Yuko Sato et al.

It is certified that error appears in the above-identified patent and that said Letters Patent is hereby corrected as shown below:

Column 13,
Line 9, "(AC polyethy A-6," should read -- (AC polyethylene A-6, --.
Line 10, "Co," should read -- Co., --.
Line 14, "copolymer" should read -- copolymer --.
Line 49, "industrial" should read -- Industrial --.

Column 16,
Lines 53-55, should be deleted.

Column 21,
Line 11, "Ex. 5" should read -- Ex. 6 --.

Signed and Sealed this

Thirteenth Day of July, 2004

JON W. DUDAS
*Acting Director of the United States Patent and Trademark Office*